United States Patent [19]

McKenna

[11] Patent Number: 4,777,897

[45] Date of Patent: Oct. 18, 1988

[54] SELF-STEERING WIND PROPELLED WATERCRAFT

[76] Inventor: Quentin M. McKenna, P.O. Box 512, Waimanalo, Hi. 96795

[21] Appl. No.: 859,084

[22] Filed: May 2, 1986

Related U.S. Application Data

[63] Continuation-in-part of Ser. No. 695,696, Jan. 28, 1985, Pat. No. 4,690,086.

[51] Int. Cl.[4] ..... B63B 1/14

[52] U.S. Cl. ..... 114/39.1; 114/61; 114/218; 24/135 R

[58] Field of Search ..... 114/39, 39.1, 61, 102, 114/218, 123; 24/135 R, 135 N

[56] References Cited

U.S. PATENT DOCUMENTS

| | | | |
|---|---|---|---|
| 112,326 | 3/1871 | Decker | 114/218 |
| 558,165 | 4/1896 | Evans | 24/135 R |
| 2,499,981 | 3/1950 | Strobel | 24/135 R |
| 3,125,058 | 3/1964 | Peterson | 114/218 |
| 3,173,395 | 3/1965 | Laurent | 114/39 |
| 3,212,109 | 10/1965 | Roman | 114/39 |
| 3,265,026 | 8/1966 | Hamilton | 114/39 |
| 3,395,664 | 8/1968 | Greenberg et al. | 114/39 |
| 3,431,623 | 3/1969 | Smeets | 24/135 R |
| 3,646,902 | 3/1972 | Smith | 114/39 |
| 3,691,976 | 9/1972 | Wilson | 114/39 |
| 3,930,562 | 1/1976 | Zorn | 114/90 |
| 3,933,110 | 1/1976 | Jamieson | 114/61 |
| 3,991,694 | 11/1976 | Black | 114/39 |
| 4,294,184 | 10/1981 | Heinrich | 114/61 |
| 4,316,424 | 2/1982 | McKenna | 114/39 |
| 4,326,475 | 4/1982 | Berte | 114/39 |
| 4,333,412 | 6/1982 | McKenna | 114/61 |
| 4,405,828 | 9/1983 | Shook | 24/135 R |
| 4,524,709 | 6/1985 | McKenna | 114/39 |

FOREIGN PATENT DOCUMENTS

| | | | |
|---|---|---|---|
| 2649577 | 5/1978 | Fed. Rep. of Germany . | |
| 2545440 | 11/1984 | Fed. Rep. of Germany | 114/61 |
| 2457212 | 1/1981 | France . | |

*Primary Examiner*—Joseph F. Peters, Jr.
*Assistant Examiner*—Thomas J. Brahan
*Attorney, Agent, or Firm*—Jeffers, Hoffman & Niewyk

[57] ABSTRACT

A wind propelled watercraft having a substantially tetrahedral frame and having three buoyant support members together forming an equilateral triangle connected thereto. Tethering assemblies are is provided for flexibly connecting the buoyant support members to the tetrahedral frame. Steering reins connected to the steering buoyant support member are received through nylon rings connected to the watercraft to provide a durable steering system. Nose ropes connected to the bow portion of the support members are provided for supporting upwardly the bow portions of the support members so as to prevent submersion of the support members in the water. Zippered storage pockets are provided on the trampoline.

29 Claims, 4 Drawing Sheets

SELF-STEERING WIND PROPELLED WATERCRAFT

This application is a continuation-in-part of application Ser. No. 695,696 filed Jan. 28, 1985 now U.S. Pat. No. 4,690,086.

BACKGROUND OF THE INVENTION

The present invention relates to wind propelled watercraft, and more particularly, to a watercraft having a substantially tetrahedral frame and three buoyant support members which together form an equilateral triangle.

One prior art sailing vessel employing a rigid frame which is generally tetrahedral is disclosed in U.S. Pat. No. 3,395,664. In one embodiment, the frame comprises six interconnected tubular members defining a triangular base connected to three buoyant support members and three triangular sides connected at an apex. In another embodiment, a lower tetrahedral frame made of similar members has a vertical mast connected to the apex thereof and is supported by a plurality of stays connected to the three corners of the triangular base.

U.S. Pat. No. 3,991,694 discloses a semi-rigid wind propelled vessel wherein the mast is similarly connected to the apex of a tetrahedral frame and is supported by a plurality of stays connected to the corners of the triangular base of the frame.

Watercraft utilizing a substantially tetrahedral frame are also described in U.S. Pat. Nos. 4,316,424, 4,333,412 and 4,524,709 issued to Quentin M. McKenna, the inventor of record herein.

Various problems have been associated with the prior art tetrahedral frame watercraft. Generally, because only a single point of the tetrahedral frame is connected to a respective buoyant support member, a sufficiently reliable, yet flexible connection between the tetrahedral frame and the respective buoyant support member has not been heretofore provided.

Furthermore, a sufficiently inexpensive yet reliable steering system has not heretofore been provided. The prior steering systems have generally been costly to manufacture and have been unreliable due to the overall structure and the chafing of the steering reins.

Other problems of the past structures include insufficient storage space and the lack of an inexpensive yet reliable and efficient method of tying the back portion of the sail in various positions.

SUMMARY OF THE INVENTION

The wind propelled watercraft, according to the present invention, is designed to overcome the above-discussed disadvantages associated with the prior art tetrahedral vessels. A tethering assembly is provided for flexibly and yet reliably connecting the buoyant support members to the tetrahedral frame. Steering reins connected to the steering buoyant support member are received through nylon rings so as to prevent chafing and provide an inexpensive yet durable steering system.

More specifically, three different tethering embodiments are provided for flexibly connecting the port and starboard buoyant support members to the stays which are connected to the ends of the port and starboard spars. In the first embodiment, a lower block is connected to the support member and has a groove for slidingly receiving therein a primary stay. An upper block is then mounted on top of the lower block using a nut and bolt assembly so as to retain the stay within the groove. In a second embodiment, inverted U-shaped members are mounted upside down on a support member thereby defining an opening between the concave portion of the U-shaped member and the support member. The stay is slidingly received within the opening. In the third tethering embodiment, two polyethylene disks having a radial slot are connected to an L-shaped bracket which, in turn, is connected to a respective buoyant support member. A stay is slidingly received within the radial slots which acts to slidingly trap the stay.

The above-described tethering means effectively connect the port and starboard buoyant support members to the tetrahedral frames. In essence, the support members are prevented from rolling over on their longitudinal axis and are also prevented from turning on the pivot point where the spar is connected to the respective support member. The forces experienced by the support members are caused by the various sea conditions and depend on the sailing direction of the watercraft. The forces can be both constant and sudden. Accordingly, the tethering systems effectively allow the support members to somewhat flex with the direction of the force while still holding the support member generally in its proper location. The tethering system can be either rigidly connected to the respective stays or they can be slidingly attached thereto. In the embodiment where a sliding connection is provided non-abrasive materials are used and, further, the respective support members are allowed to flex a generally greater distance. In the embodiment where the tethering system is rigidly connected to the respective primary stay the support members flex a shorter distance. It should be noted that in all tethering embodiments, the primary stays are connected to the respective support members substantially above the water so as to avoid frictional drag.

Furthermore, the above-described tethering embodiments are separable thereby making the assemblying of the tetrahedron much easier. In the past, where eyelets have been used to connect the stays to the support members, the stays had to first be threaded through the eyelets. Thereafter, the stays were connected to the ends of the respective spar members and the tetrahedron was tightened. That was cumbersome and time consuming because the support members cannot easily be twisted to the correct location so as to thread the stay through the eyelet and then connect the stay to the spar end. The tethering embodiments of the present application, however, do not require the stays to first be threaded. In the tethering embodiments of the present invention, the stays can first be directly connected to the spar ends and the tetrahedron tightened. Thereafter, the support members can be twisted to their ultimate correct location and the separable tethering means can be used to connect the support members to the respective stays. As can be appreciated, the tethering embodiments provide a means for more quickly and easily assemblying the tetrahedron and thereafter connecting the support members to the respective stays.

Two steering embodiments are also provided. The first steering embodiment includes two steering reins which are connected to the buoyant steering support member which in turn has a centerboard extending downwardly therefrom. The steering reins are received through nylon rings connected to a stay located on the respective port and starboard sides. Thereafter, the steering reins are received through a grommet located on the trampoline on the respective port and starboard sides. In a second steering embodiment, the steering reins, after being received through the nylon rings connected to the port and starboard side stays, are received through another respective nylon ring connected to the ends of a trampoline support tube on the respective port and starboard sides. The nylon rings substantially prevent chafing.

The sail of the watercraft is connected to the same semi-circular eyes used for the.stay connecting together the steering spar end and the vertical spar end. The back portion of the sail is connected to the watercraft using a rope which is wrapped around the stay connecting together the port spar end and the starboard spar end. Thereafter, this rope can be either fastened to the port and starboard spars or fastened to horn cleats connected to the port and starboard spars. Storage pockets connected to the trampoline are provided and include a zipper for opening and closing them.

In one form thereof, the present invention reaates to a wind propelled watercraft including a buoyant steering support member, a buoyant port support member and a buoyant starboard support member which are spaced substantially equidistantly from each other. A steering spar is connected to the steering support member and to a juncture, a port spar is connected to the port support member and to the juncture, and a starboard spar is connected to the starboard support member and to the juncture. A vertical spar is connected to the juncture and extends vertically upwardlv. The spars are substantially equilength and form an angle of approximately 110° with each other at the juncture. Three substantially equilength primary stays connect together the ends of the steering, port and starboard spars so as to substantially form an equilateral triangle and three substantially equilength secondary stays, which are also the same length as the primary stays, connect together the ends of the steering, port and starboard spars to the end of the vertical spar. The primary and secondary stays together form an equilateral tetrahedron. A separable port tethering means connected to the port member is provided for detachably connecting the port support member to a primary stay which is connected to the port spar. Further, a separable starboard tethering means connected to the starboard support member is provided for detachably connecting the starboard support member to a primary stay connected to the starboard spar.

In one form thereof, the present invention relates to a wind propelled watercraft including a buoyant steering support member, a buoyant port support member and a buoyant starboard support member which are spaced substantially equidistantly from each other. A steering spar is pivotally connected to the steering support member and to a juncture, a port spar is connected to the port support member and to the juncture and a starboard spar is connected to the starboard support member and to the juncture. A vertical spar is connected to the juncture and extends vertically upwardly. The spars are substantially equilength and form an angle of approximately 110° with each other at the juncture. Three substantially equilength primary stays connect together the ends of the steering, port and starboard spars so as to substantially form an equilateral triangle and three substantially equilength secondary stays, which are also the same length as the primary stays, connect together the ends of the steering, port and starboard spars to the end of the vertical spar. Centerboards extending downwardly from each of the support members are provided. A port steering rein and a starboard steering rein are connected to the steering support member. A first port pulley means is connected to the primary stay which is connected between the steering spar end and the port spar end and a first starboard pulley means is connected to the primary stay which is connected between the steering spar end and the starboard spar end. The first port pulley means receives therethrough the port rein and the first starboard pulley means receives therethrough the starboard rein. A trampoline connected to the steering, port and starboard spars is provided and has connected thereto a second port side pulley means and a second starboard side pulley means. The port rein is received through the second port side pulley means and the starboard rein is received through the second starboard side pulley means. Accordingly, by providing tension to a respective rein, the steering support member can be directionally adjusted.

In one form thereof, the present invention relates to a wind propelled watercraft including a buoyant steering support member, a buoyant port support member and a buoyant starboard, support member which are spaced substantially equidistantly from each other. A steering spar is pivotally connected to the steering support member and to a juncture, a port spar is connected to the port support member and to the juncture, and a starboard spar is connected to the starboard support member and to the juncture. A vertical spar is connected to the juncture and extends vertically upwardly. The spars are substantially equilength and form an angle of approximately 110° with each other at the juncture. Three substantially equilength primary stays connect together the ends of the steering, port and starboard spars so as to substantially form an equilateral triangle and three substantially equilength secondary stays, which are also the same length as the primary stays, connect together the ends of the steering, port and starboard spars to the end of the vertical spar. Centerboards extending downwardly from each of the support members are provided. A port steering rein and a starboard steering rein are connected to the steering support member. A first port pulley means is connected to the primary stay which is connected between the steering spar end and the port spar end, and a first starboard pulley means is connected to the primary stay connected between the steering spar end and the starboard spar end. The first port pulley means receives therethrough the port rein and the first starboard pulley means receives therethrough the starboard rein. A trampoline is connected to the steering, port and starboard spars. A trampoline rigid support member is connected to the watercraft for supporting the trampoline. A second port side pulley means is connected to the trampoline support member and a second starboard pulley means is also connected to the trampoline support member. The port rein is received through the second port side pulley means and the starboard rein is received through the second starboard side pulley means. Accordingly, by providing tension to a respective rein, the steering support member can be directionally adjusted.

BRIEF DESCRIPTION OF THE DRAWINGS

The above-mentioned and other features and objects of this invention and the manner of attaining them will become more apparent and the invention itself will be better understood by reference to the following description of an embodiment of the invention taken in conjunction with the accompanying drawings wherein.

Corresponding reference characters indicate corresponding parts throughout the several views of the drawings.

The exemplifications set out herein illustrate a preferred embodiment of the invention in one form thereof and such exemplifications are not to be construed as limiting the scope of the disclosure or the scope of the invention in any manner.

DETAILED DESCRIPTION OF A SPECIFIC EMBODIMENT

Figure 1:
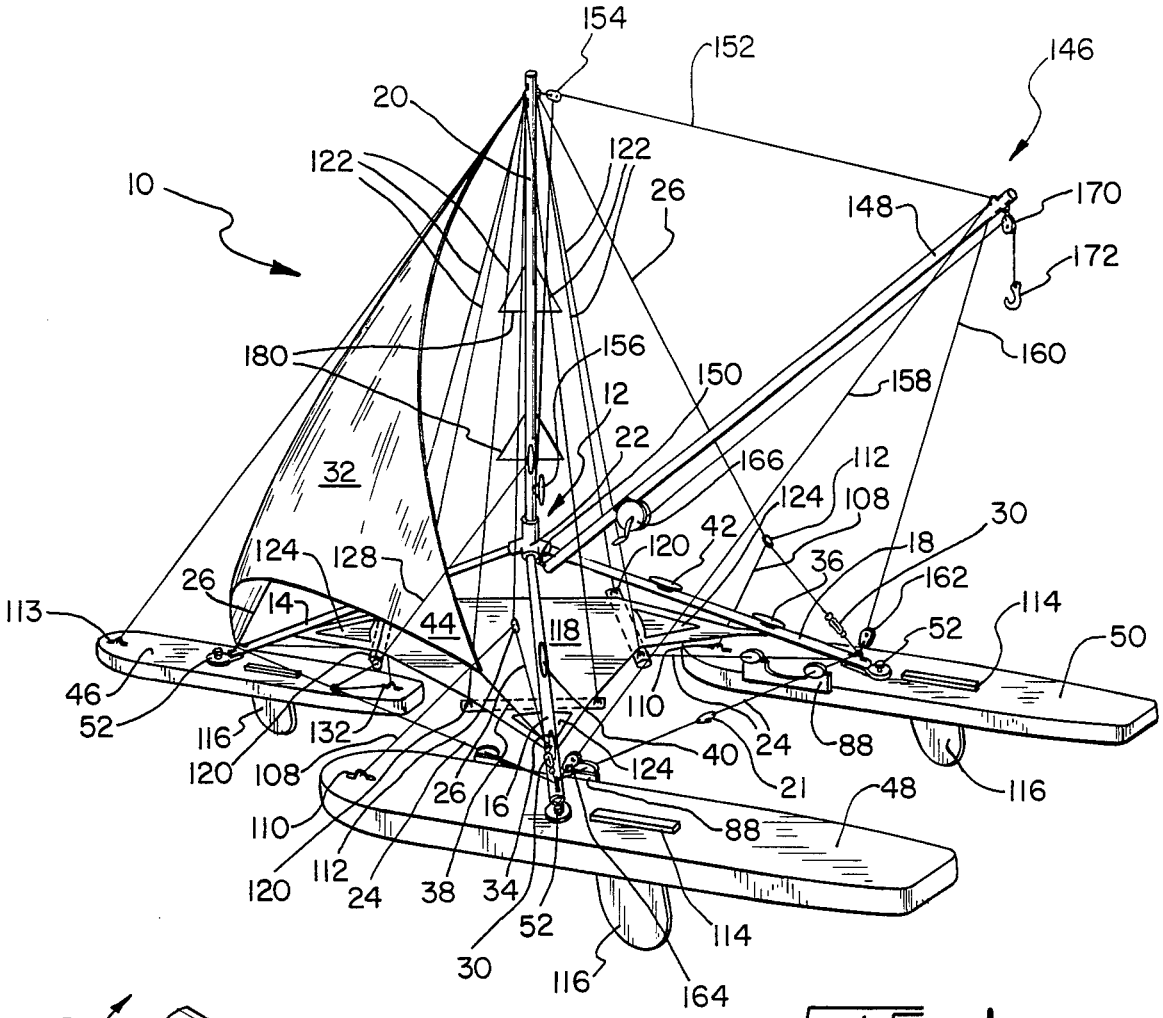
FIG. 1 is a perspective view of the wind propelled watercraft according to the present invention.

As shown in FIG. 1, a specific embodiment of the present invention is a wind propelled watercraft generally indicated as 10. Watercraft 10 is made up of frame 12 as generally indicated which has four substantially rigid equilength spar members 14, 16, 18 and 20. Spar members 14, 16, 18 and 20 are generally cylindrically-shaped pipes preferably made of aluminum. Spar members 14, 16, 18 and 20 are connected at one end thereof to a juncture member 22 such that said spar members form substantially equal angles of approximately 110° relative to one another. Spar 20 is generally vertically disposed. Spars 14, 16 and 18 are disposed generally angularly downwardly.

Hereinafter, in order to make the description of watercraft 10 more easily understood, spar member 14 will be designated as the bow or steering spar, spar member 16 will be designated as the port spar, spar member 18 will be designated as the starboard spar, and spar member 20 will be designated as the vertical spar.

Watercraft 10 has three primary stays 24 and three secondary stays 26. Primary stays 24 extend between and connect together the three bow, port and starboard spars 14, 16 and 18. Secondary stays 26 extend between and connect together a respective bow, port or starboard spar 14, 16 or 18 with the vertical spar 20. Primary stays 24 and secondary stays 26 are made of a suitable cable or wire to withstand the forces created at each spar end. Further, primary stays 24 and secondary stays 26 are equal in length and, thus, together define an equilateral tetrahedral frame. In constructing the equilateral tetrahedral frame, first, primary stays 24 are connected to the ends of the bow, port and starboard spars 14, 16 and 18 so as to substantially form an equilateral triangle with primary stays 24. It should be noted that a detachable shackle or link 21 can be provided on the stern primary stay so as to make the construction of the equilateral triangle quicker and easier. Then, secondary stays 26 are connected, as described above, between a respective bow, port and starboard spar end and the vertical spar end and thereafter turnbuckle 30 positioned on a secondary stay near either the port or starboard spar end is tightened until a substantially equilateral tetrahedral frame is formed by the primary and secondary stays 24 and 26 respectively. In this fashion, sail 32 is also tensioned simultaneously with the forming of the tetrahedral frame because sail 32 is connected, via semicircular eyes to the steering and vertical spar ends.

Figure 4:
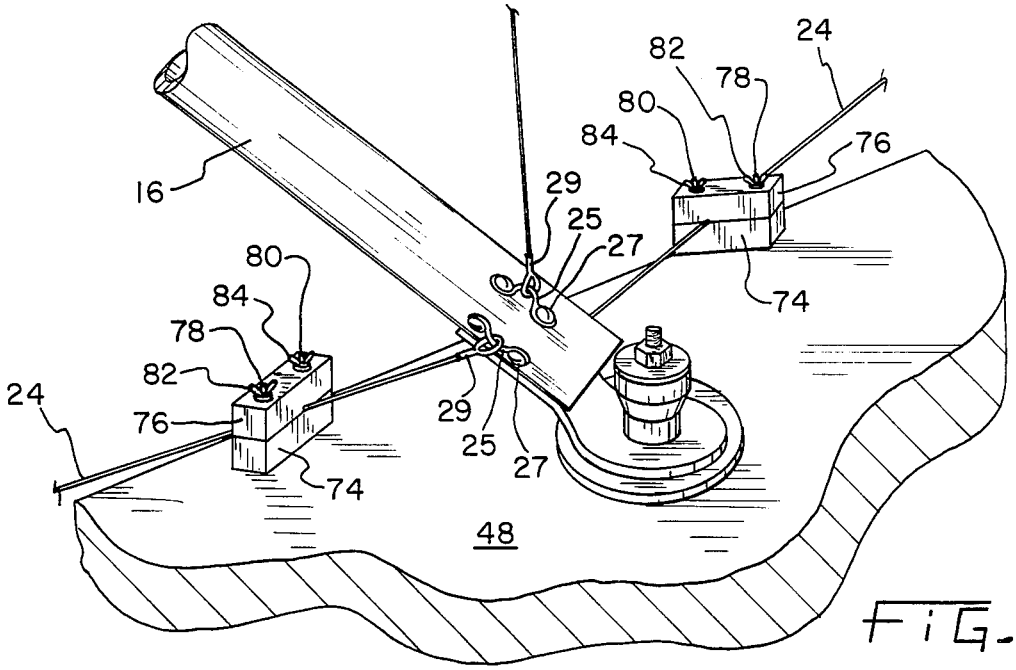
FIG. 4 is one embodiment of a tethering system for the watercraft shown in FIG. 1.

As shown in FIG. 4, each stay is connected to a respective spar end through the use of semicircular eyes 25, screws 27 and eyelets 29. That is, semicircular eyes 25 are first slipped through eyelets 29 and thereafter semicircular eyes 25 are connected to a respective spar end by threadably fastening screws 27 in threaded holes provided in the respective spar ends (not shown). In this fashion, the forces are effectively transferred by each respective stay to the spar ends in a reliable yet inexpensive manner.

As shown in FIG. 1, the semicircular eyes for primary stay 26 which is connected between the end of the bow spar 14 and the vertical spar 20, are used to also mount thereupon the front portion of sail 32. Back portion 44 of sail 32 can be connected via rope 38 to horn cleat 34 mounted on port spar 16 In the alternative, back portion 44 of sail 32 can be connected via rope 38 to horn cleat 36 which is mounted on starboard spar 18. Horn cleats 34 and 36 are ideally mounted approximately five-sixths of the distance from juncture 22 to a respective spar end. In situations where the wind is traveling substantially in the same direction as watercraft 10, the back portion of sail 32 can be extended outward by slackening rope 38, connected to lower horn cleats 34 or 36

Figure 7:
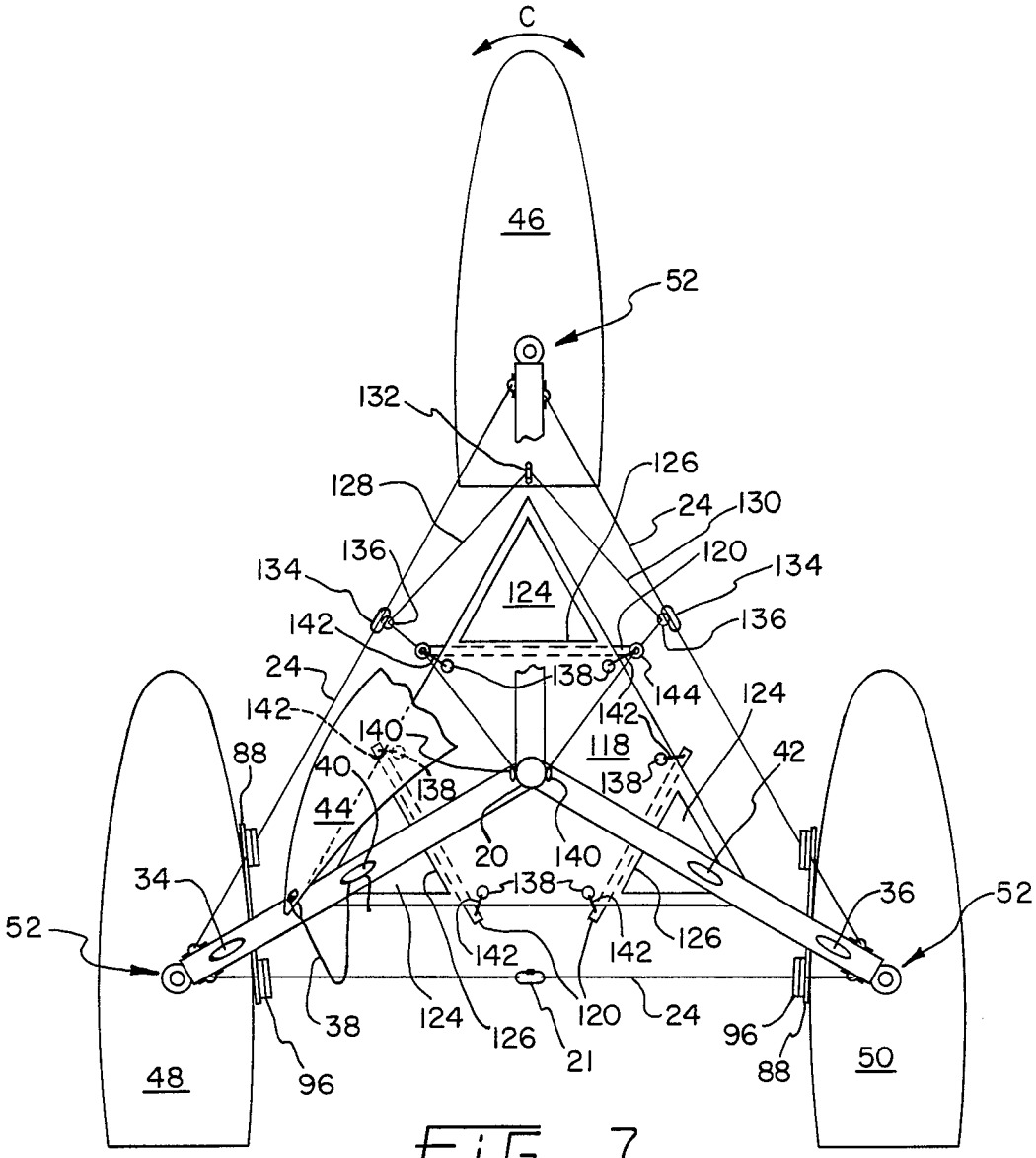
FIG. 7 is a top plan view of the watercraft shown in FIG. 1 showing another steering embodiment.

In a different embodiment, back portion 44 of sail 32, as shown in FIG. 7, can be held in position by wrapping rope 38 around rear primary stay 24 connected between the ends of port spar 16 and starboard spar 18 and thereafter tacking it on a respective horn cleat 34, 36, 40 or 42. In this fashion, back portion 44 of sail 32 can be located further back thereby providing a better in-board sail position for close-reaching into the wind and permitting an infinite number of sail adjustment positions forwardly and backwardly.

Figure 6:
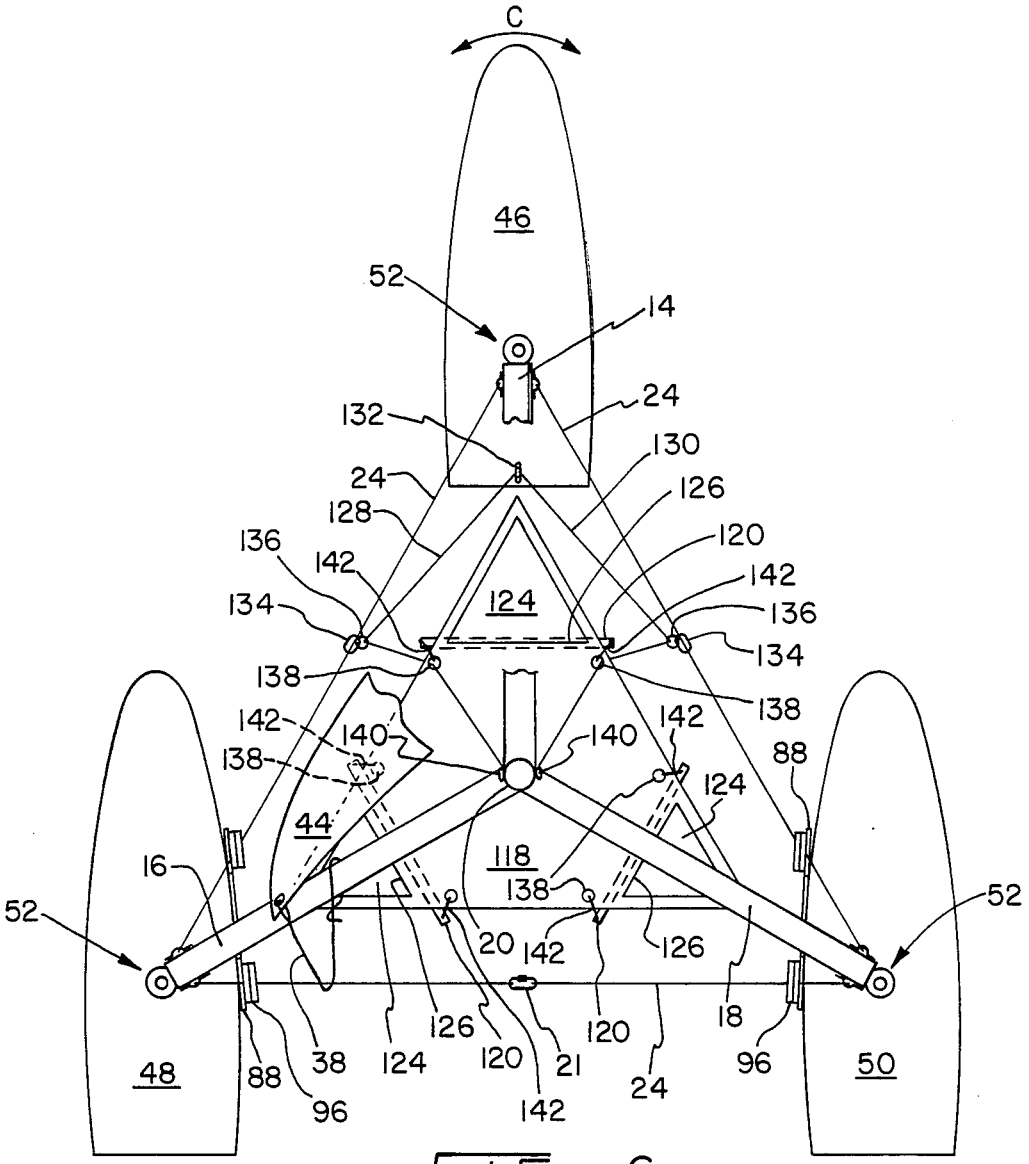
FIG. 6. is a top plan view of the watercraft shown in FIG. 1 showing one steering embodiment.

In a yet further embodiment, as shown in FIG. 6, back portion 44 of sail 32 is held in position by wrapping rope 38 around rear primary stay 24 connected between the ends of port spar 16 and starboard spar 18 and thereafter tying rope 38 around a respective port or starboard spar. In this embodiment, the reach of sail 32 can likewise be adjusted to an infinite number of positions not only forwardly and backwardly, but also between the ends of port spar 16 and starboard spar 18. In this manner, rear primary stay 24 acts much like what is commonly known as a sail traveler. The friction of rope 38 around primary stay 25 permits sail adjustment positions somewhat independent of the horn cleat positions without slippage. Thus, with this embodiment, both the angular direction of sail 32 and the tension of sail 32 can be adjusted accordingly for a desired sailing situation with respect to the wind direction and speed.

As shown in FIGS. 1, 6 and 7, bow spar 14 is connected to buoyant bow or steering support member 46. Port spar 16 is connected to buoyant port support member 48 and starboard spar 18 is connected to buoyant starboard support member 50. The connections are made via a mounting assembly 52.

Figure 2:
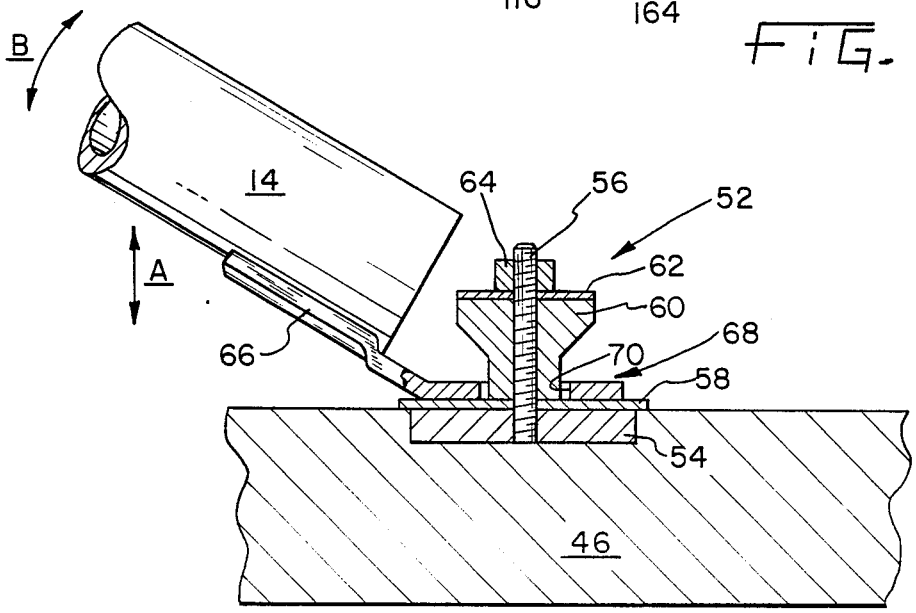
FIG. 2 is a cross-sectional elevation view of a connection between a spar end and a support member of the watercraft of FIG. 1.

An example of mounting assembly 52 is shown in FIG. 2 wherein bow spar 14 and support member 46 are shown in cross section. Mounting assembly 52 has a plate member 54 positioned in a depression within buoyant support member 46. Threaded bolt 56 is welded or otherwise secured to plate member 54 and extends vertically upwardly therefrom. Annular cushion member 58 lies on the upper surface of plate member 54 and has threaded bolt 56 traveling therethrough. Bushing 60 and washer 62 are slidably received on the upper portion of threaded bolt 56. A nut 64 is threadably secured upon threaded bolt 56 so as to hold washer 62 securely against bushing 60 and bushing 60 securely against cushion member 58. Mounting bracket 66 is connected to the end of bow spar 14 by welding or other suitable fastening means. Mounting bracket 66 has an annular portion generally indicated as 68 which has an inner diameter 70. Inner diameter 70 is greater than the smaller straight outer diameter 72 of bushing 60. Accordingly, bow spar member 14 is mounted to buoyant bow support member 46 in a flexible fashion. That is, bow spar member 14 can move upwardly and downwardly as shown by arrows A and, further, can also move angularly, as indicated by arrows B, with respect to support member 46. Further yet, without any other means to mount support member 46 to bow spar 14, bow spar 14 is capable of pivoting around support member 46.

The forces exerted by the movement of bow spar member 14 with respect to support member 46 upon mounting assembly 52 are absorbed by cushion member 58 and by bushing 60. Therefore, damage which could occur from sudden impact forces between the various members of mounting assembly 52 is prevented.

The port and starboard support members 48 and 50 are further flexibly connected to their respective port and starboard spar members 16 and 18 respectivelv via a tethering system. Broadly speaking, the tethering system flexibly connects the respective support member to primary stays 24 which, as discussed above, are connected to the ends of the bow, port and starboard spar members 14, 16 or 18.

Figure 5:
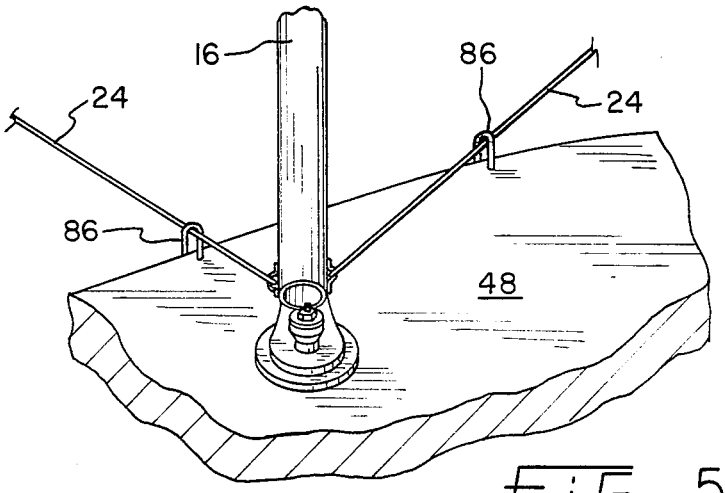
FIG. 5 is another embodiment of a tethering system for the watercraft shown in FIG. 1.
Figure 8:
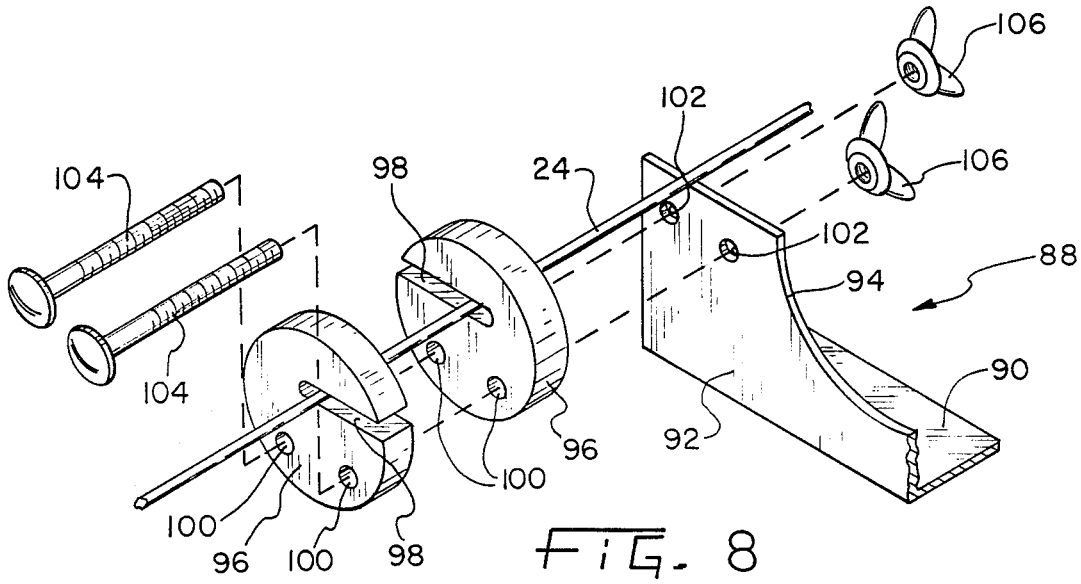
FIG. 8 is another tethering embodiment for the watercraft shown in FIG. 1.

In FIGS. 4, 5 and 8, various tethering systems of support member 48 are exemplarily shown. The first tethering embodiment, shown in FIG. 4, includes a lower block 74 and an upper block 76. Blocks 74 and 76 are preferably made of polyethylene. Lower block 74 is connected to port support member 48. The upper surface of lower block 74 has a groove (not shown) of adequate depth to maintain therein one of primary stays 24. Upper block 76 fits on top of lower block 74 so as to hold primary stays 24 within the groove of lower block 74. Anchored threaded bolts 78 and 80 are connected to lower block 74 and protrude upwardly therefrom. Bolts 78 and 80 are received within the respective holes of upper block 76. A pair of wing nuts 82 and 84 are threadably received on the upper protruding portion of bolts 78 and 80 respectively to hold tightly together lower block 74 and upper block 76. Thus, primary stay 24 is slidingly retained within the groove of lower block 74.

In a second tethering embodiment, as shown in FIG. 5, U-shaped members 86 are mounted upside down, in an inverted fashion, onto support member 48. The legs of U-shaped members 86 are effectively threaded (not shown) and inserted through holes located on support member 48. Nuts (not shown) are then threaded upon each leg of U-shaped members 86 so as to hold U-shaped members 86 upon support member 88. An opening is thus formed between the concave portion of U-shaped members 86 and support member 48. Primary stays 24 are thereafter passed through the opening. Thus, support member 48 is slidingly connected to primary stays 24 which are connected to the bow, port and starboard spar members.

In a third tethering embodiment, as shown in FIGS. 1, 6, 7 and 8, an L-shaped bracket 88 is mounted to a respective port and starboard support member. This is done by inserting lower leg 90 of L-shaped bracket 88 into a slot (not shown) within a respective port and starboard support member 48 and 50 and glued therein with a suitable gluing material. Upper leg 92 of L-shaped bracket 88 has a circular edge 94 formed therein by cutting away a circular portion of upper leg 92. Circular edge 94 is positioned substantially below a respective port or starboard spar so that during extreme conditions, when the spar members are moving angularly or vertically upwardly and downwardly, the spar members will not make contact with upper leg 92 of L-shaped bracket 88. L-shaped bracket 88 is made of aluminum or other suitable material.

As shown more clearly in FIG. 8, two disk members 96 made of ultra high molecular weight, polyethylene, and, having radial slots 98, are provided for slidably connecting L-shaped bracket 88 to a respective primary stay 24. Disc members 96 have mounting holes 100 which correspond with mounting holes 102 located on upper leg 92 of L-shaped bracket 88. Bolts 104 are provided to be inserted through mounting holes 100 of two discs having radial slots 98 oppositely disposed and through mounting holes 102. Thereafter, wing nuts 106 are threadably secured upon bolts 104 so as to tighten together the two disk members 96 onto upper leg 92 of L-shaped bracket 88. In this third embodiment, as in the first embodiment, it can be seen that primary stay 24 can be connected to a respective port or starboard support member in a substantially quick and easy fashion.

In all the tethering embodiments described above, additional reliable yet flexible stability is provided as needed in rough seas. The support members, commonly known as pontoons, generally have forces exerted upon them which cause them to roll on their longitudinal axis and to also twist around a respective mounting assembly 52. These forces can be sudden or continuous and directionally depend on the condition of the sea and the directional movement of watercraft 10. Accordingly, the above three described tethering embodiments effectively keep the support members from twisting or rolling out of position. It should be noted that the connection to a respective primary stay 28 can either be sliding or rigid. As can be appreciated, the rigid connection provides less flexibility for the support members than does the sliding connection. This is because the sliding connection allows the tethering means to travel to the point of greatest deflection by a respective primary stay 28. It should also be noted that in the sliding connection embodiment, the non-abrasive materials used and described above are essential.

In operation, because the above-described tethering embodiments are separable, the assembly of the tetrahedron is made considerably less time consuming and less cumbersome. Without regard to the alignment of the support members, the primary and secondary stays are first connected to the ends of the spar members and tightened so as to form the tetrahedron. Thereafter, each support member is properly aligned and, through the use of the respective tethering means, each support member is connected to the respective primary stays.

It should also be noted that through the use of the above-described tethering means, primary stays 28 can effectively be kept above the water during sailing, thereby eliminating any frictional drag which could occur.

Overall separable port tethering means connected to the port support member is provided for detachably connecting the port support member to a primary stay which is connected to the port spar. Further, a separable starboard tethering means connected to the starboard support member is provided for detachably connecting the starboard support member to a primary stay connected to the starboard spar.

Port support member 48 and starboard support member 50 are further held in position through the use of short-nose ropes 108. Nose ropes 108 are connected to a respective support member through the use of semicircular eyes 110 mounted to a respective support member. Short-nose ropes 108, at the other end thereof, are connected to a respective secondary stay 26 through the use of detachable shackles or links 112. Short-nose ropes 108 are thus used to prevent the forward tips of the respective port or starboard support members from burying into the water during extreme conditions and rough seas.

As shown in FIG. 1, bow support member 46 is also prevented from burying into the water during extreme conditions in rough seas through the use of bow nose rope 111. Bow nose rope 111 is connected to semicircular eye 113 which is mounted on the bow portion of bow support member 46. Bow nose rope 111 is also connected to the end of vertical spar 20. Thus, bow support member 46 is capable of pivoting around mounting assembly 52 while at the same time, the nose of bow support member 46 is prevented from burying into the water during extreme conditions.

Figure 3:
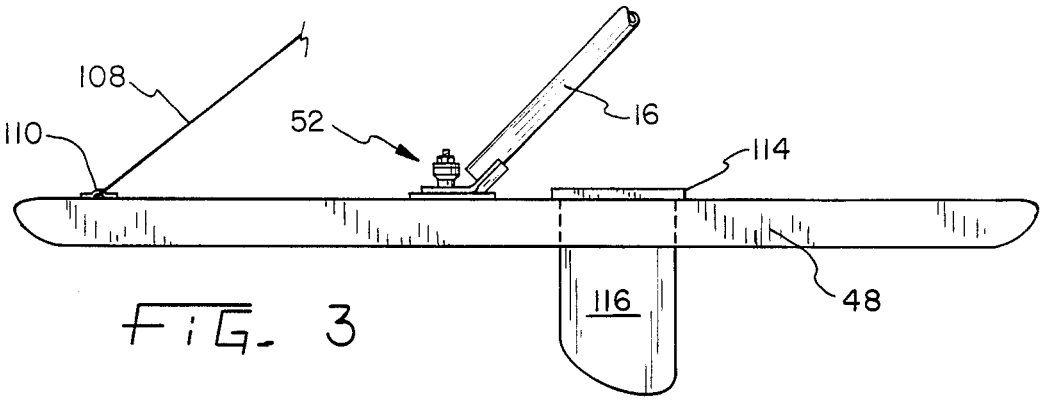
FIG. 3 is a side elevational view of a support member shown in FIG. 1.

As shown in FIGS. 1 and 3, each buoyant support member is substantially flat and elongated resembling a pontoon. In FIG. 3, buoyant port support member 48 is shown exemplifying also support members 46 and 50. A centerboard box 114 is located directly behind mounting assembly 52. Centerboard 116 is thus inserted through centerboard box 114 after watercraft 10 is placed on the water so as to stabilize the directional movement of watercraft 10. It should be noted that more than one centerboard 116 may be used for each support member and can be individually located either in back or in front of assembly 52. However, centerboards 116 should be located substantially near mounting assembly 52. With respect buoyant support member 46, so as to more easily be able to insert centerboard 116 within centerboard box 114, the centerboard box ideally should be located forwardly of assembly 52. Further, with respect to port support member 48 and starboard support member 50, a centerboard box 114 and, thus, a centerboard 116 ideally may be located both in front and behind assembly 52 thereby providing a greater centerboard surface within the water at both the port and starboard support member locations.

Trampoline 118 is made of canvas or other suitable lightweight flexible material and, as shown in FIGS. 1, 6 and 7, has substantially the shape of an equilateral triangle. Trampoline 118 is connected at its vertices to the bow, port and starboard spar members 14, 16 or 18 at a point substantially equal in distance from each spar member end. Three rigid trampoline support tubes 120 are attached to the underside of trampoline 118 and are supported upwardly via trampoline support stays 122 which are connected to the end of a respective trampoline support tube 120 and the end of the vertical spar member 20.

Figure 9:
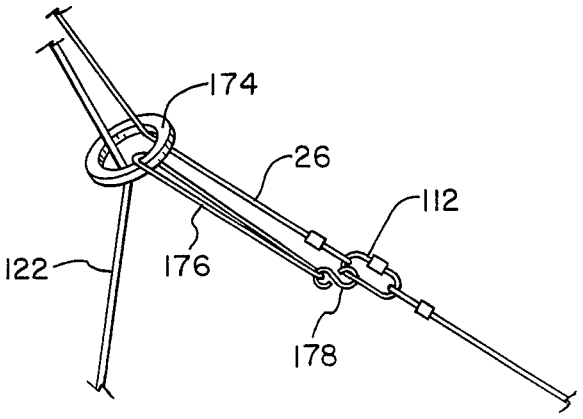
FIG. 9 shows a trampoline prrmary stay pulled close to a secondary stay with a nylon ring.

Trampoline support stays 122 can also be detachably connected to a respective secondary stay thereby pulling support stays 122 away from vertical spar 20 so as to better position back portion 44 of sail 22 about watercraft 10. To this end, as shown in FIG. 9, there is provided a pull back nylon ring 174 which receives therethrough a secondary stay 26 and a trampoline support stay 122. Short cord 176 is attached to pull back nylon ring 174 at one end thereof and is attached to S-hook 178 at the other end thereof. During normal operation, pull back nylon ring 174 is located substantially near the end of vertical spar 20 where secondary stays 26 and trampoline support stays 122 are relatively close to one another. When it is desired to pull trampoline support stays 122 outboard towards secondary stays 26, pull back nylon ring 174 is pulled downwardly and connected to detachable shackles or links 112 via short cord 176 and S-hook 178. Thus, trampoline support stays 122 are pulled outboard near secondary stays 26 so as to substantially be out of the way of sail back portion 44. Furthermore, the pulling of trampoline support stays 122 toward secondary stays 26 acts to tension both primary stays 24 and secondary stays 26. Consequently, it is possible to eliminate turnbuckle 30 and provide all the necessary tensioning to both primary stays 24 and secondary stays 26 with the use of pull back nylon rings 174, short cords 176 and S-hooks 178.

A storage pocket 124 is sewn into or otherwise secured at each corner of trampoline 118. A zipper 126 or other suitable means is provided at the inner end of each storage pocket 124 so as to selectively allow access therein. 15 The traveling direction of watercraft 10 is selectively controlled by angularly adjusting bow support member 46 as indicated in FIGS. 6 and 7 by arrows C. The angular adjustment of bow support member 46 is accomplished by adjusting port steering rein 128 and starboard steering rein 130. Both steering reins 128 and 130 are connected to bow support member 46 at steering rein juncture 132 in a rigid fashion.

In the first steering embodiment, as shown in FIG. 6, steering reins 128 and 130 are received through first pulley means which, in the preferred embodiment, are depicted as first nylon rings 136 which are connected to primary stay shackles 134. Thereafter, steering reins 128 and 130 are received through respective second pulley means which in the preferred embodiment are grommets 138 located on trampoline 118. Steering reins 128 and 130 are then secured to a respective steering rein horn cleat 140 located on vertical spar member 20. Grommet 138 is held in position against the forces exerted thereon by the respective steering reins 128 and 130 via respective grommet securing ropes 142 which are connected to bow trampoline support tube 120 and received through grommet 138. Grommet securing ropes 142 and grommets 138 are also used to tension trampoline 118 along each respective trampoline support tube 120. Consequently, the inside diameter of grommet 138 is sufficiently large enough to receive therethrough both grommet securing rope 142 and a respective steering rein 128 or 130 when needed. As can be appreciated in this first steering embodiment, the use of nylon ring 136 and grommet 138 provide an assembly whereby the angular position of bow support member 46 can be efficiently and accurately adjusted, and further, chafing of the steering reins and trampoline can be avoided. The life of the steering reins and trampoline are, thus, substantially lengthened.

In a second steering embodiment, as depicted in FIG. 7, steering reins 128 and 130 are also received through a respective first pulley means which, in the preferred embodiment, are depicted as first nylon rings 136 which are connected to a respective primary stay shackle 134. Thereafter, however, steering reins 128 and 130 are received through respective second pulley means, which in the preferred embodiment are depicted as second nylon rings 144 which are connected to each end of bow trampoline support tube 120. Steering reins 128 and 130 are thereafter, as in the first steering embodiment discussed above, secured to steering rein horn cleats 140 located on vertical spar member 20. As can be appreciated, in the second steering embodiment, second nylon rings 144 are more rigidly connected and, thus, a more accurate steering position can be retained during the operation of watercraft 10. Furthermore, chafing of steering reins 128 and 130 is substantially eliminated.

A derrick assembly 146 is provided at the rear of watercraft 10 for pulling and lifting various objects. Derrick assembly 146 includes derrick arm 148 which is flexibly connected to juncture member 22 via a chain 150. Derrick arm 148 is a tube made of aluminum or other suitable material. Derrick assembly 146 further includes cable 152 connected to the outward end of derrick arm 148 at one end thereof and which is received through pulley 154 located at the upper end of vertical spar member 20. Thereafter, cable 152 is secured to derrick horn cleat 156 which is mounted upon vertical spar member 20 near juncture member 22. Thus, derrick cable 152 is used to hold derrick arm 158 in an upwardly pointing direction.

Derrick arm 148 is further stabilized by using port stabilizing cable 158 and starboard stabilizing cable 160, both of which are connected to the end of derrick arm 148. Starboard stabilizing cable 160 travels around starboard pulley 162 connected to the end of starboard spar member 18 and thereafter is secured to horn cleat 36. Port stabilizing cable 158 travels around port pulley 164 connected to port spar member 16 and thereafter is secured to horn cleat 34. Thus, stabilizing cables 158 and 160 prevent derrick arm 148 from swinging back and forth between the port and the starboard sides of watercraft 10.

Derrick assembly 146 further includes wench 166 connected to derrick arm 148. Working cable 168 is received within wench 166 in a customary fashion and extends outwardly to the end of derrick arm 148 whereat it travels around working pulley 170 connected to the end of derrick arm 148. At the end of working cable 168, there is connected hook 172 whereby various objects can be lifted and pulled.

As shown in FIG. 1, steps 180 are connected onto vertical spar member 20 by pop riveting or other suitable fastening means. Steps 180 are useful in that they permit easy access to the top of vertical spar member 20 for installing and removing sail 32.

It should further be noted that watercraft 10 substantially provides for self-piloting. That is, upon directionally setting steering support member 46 and tacking sail 32 with respect to the direction of the wind, watercraft 10 will automatically maintain the preset heading relative to the wind direction.

While the invention has been described as having specific embodiments, it will be understood that it is capable of further modifications. This application is therefore intended to cover any variations, uses or adaptations of the invention following the general principles thereof and including such departures from the present disclosure as come within known or customary practice in the art to which this invention pertains and fall within the limits of the appended claims.

What is claimed is:

1. A wind propelled watercraft comprising:

a buoyant steering support member;

a buoyant port support member;

a buoyant starboard support member, said support members spaced substantially equidistantly from each other;

a steering member spar connected to said steering support member at one end thereof and to a spar juncture at the other end thereof;

a port spar connected to said port support member at one end thereof and to said juncture at the other end thereof;

a starboard spar connected to said starboard support member at one end thereof and to said juncture at the other end thereof;

a vertical spar connected to said juncture extending vertically upwardly therefrom, said spars being substantially equilength and forming an angle of approximately 110° with each other at said juncture;

three substantially equilength primary stays connecting together the ends of said steering, port and starboard spars and substantially forming an equilateral triangle;

three substantially equilength secondary stays, equal in length to said primary stays, connecting together the ends of said steering, port and starboard spars to the end of said vertical spar, whereby said primary and secondary stays together form an equilateral tetrahedron;

separable port tethering means connected to said port support member for detachably connecting said port support member to a primary stay connected to said port spar; and separable starboard tethering means connected to said starboard support member for detachably connecting said starboard support member to a primary stay connected to said starboard spar;

each of said tethering means comprising an upper retainer member, and a lower retainer member connected to said suport member, said lower retainer member being located below said primary stay, a groove in one of said retainer members for receiving therein said primary stay, said upper retrainer member being detachably connected to said lower retainer member, the other of said retainer members covering said groove, said primary stay being retained within said groove, said detachable connection including a first fastener member that is anchored in said lower retainer member and extends upwardly through a hole within said upper retainer member, and a second fastener member removably received on said first fastener member whereby said upper retainer member is detachably secured on said lower retainer member and said first fastener member remains in place when said upper retainer member is removed.

2. The watercraft of claim 1 wherein each of said tethering means slidingly connects said support member to said primary stay 3. The watercraft of claim 1 wherein each of said tethering means comprises a U-shaped member having its legs detachably connected to said support member thereby defining an opening between said support member and the concave portion of said U-shaped member, said primary stay slidingly received through said opening.

4. The watercraft of claim 1 wherein each of said tethering means comprises: a lower block connected to said support member, said lower block being located below said primary stay and having a groove for receiving therein said primary stay, an upper block detachably connected to said lower block on top of said groove whereby said primary stay is retained within said groove, and wherein said groove is larger in cross section than said primary stay allowing said primary stay to slide therein.

5. The watercraft of claim 4 wherein said detachable connection includes two bolts connected to said lower block and extending upwardly through two holes within said upper block, and two nuts threadably received on said bolts whereby said upper block is detachably secured upon said lower block.

6. The watercraft of claim 1 wherein said first fastener member is a bolt and said second fastener member is a nut threadedly connected thereto.

7. The watercraft of claim 6 wherein said retainer members are blocks.

8. The watercraft of claim 6 including a plurality of said first and second fastener members.

9. A wind propelled watercraft comprising:

a buoyant steering support member;

a buoyant port support member;

a buoyant starboard support member, said support members spaced substantially equidistantly from each other;

a steering member spar connected to said steering support member at one end thereof and to a spar juncture at the other end thereof;

a port spar connected to said port support member at one end thereof and to said juncture at the other end thereof;

a starboard spar connected to said starboard support member at one end thereof and to said juncture at the other end thereof;

a vertical spar connected to said juncture extending vertically upwardly therefrom, said spars being substantially equilength and forming an angle of approximately 110° with each other at said juncture;

three substantially equilength primary stays connecting together the ends of said steering, port and starboard spars and substantially forming an equilateral triangle;

three substantially equilength secondary stays, equal in length to said primary stays, connecting together the ends of said steering, port and starboard spars to the end of said vertical spar, whereby said primary and secondary stays together form an equilateral tetrahedron;

separable port tethering means connected to said port support member for detachably connecting said port support member to a primary stay connected to said port spar;

separable starboard tethering means connected to said starboard support member for detachably connecting said starboard support member to a primary stay connected to said starboard spar;

each of said tethering means comprising: a bracket mounted to a respective support member, two planar members each having a slot starting at a peripheral edge and having a first and a second planar surface, said stay being received within said slots of said two planar members and the first surface of one planar member facing the second surface of the other planar member whereby said stay is retained by said planar members, and connecting means for connecting said planar members to said bracket.

10. The watercraft of claim 9 wherein said planar members are made of ultra high molecular weight polyethylene and said bracket is made of aluminum.

11. The watercraft of claim 9 wherein said bracket is L-shaped having a first leg connected to said support member and a second leg extending substantially vertically upwardly and having two holes therein, and wherein said planar members are disk-shaped each having two holes therein corresponding with said two holes of said second leg, and wherein said connecting means comprises two bolts received through said disk holes and said second leg holes and two nuts for threadably fastening together said disks to said bracket.

12. A wind propelled watercraft comprising:

a buoyant steering support member;

a buoyant port support member;

a buoyant starboard support member, said support members spaced substantially equidistantly from each other;

a steering member spar connected to said steering support member at one end thereof and to a spar juncture at the other end thereof;

a port spar connected to said port support member at one end thereof and to said juncture at the other end thereof;

a starboard spar connected to said starboard support member at one end thereof and to said juncture at the other end thereof;

a vertical spar connected to said juncture extending vertically upwardly therefrom, said spars being substantially equilength and forming an angle of approximately 110° with each other at said juncture;

three substantially equilength primary stays connecting together the ends of said steering, port and starboard spars and substantially forming an equilateral triangle;

three substantially equilength secondary stays, equal in length to said primary stays, connecting together the ends of said steering, port and starboard spars to the end of said vertical spar, whereby said primary and secondary stays together form an equilateral tetrahedron;

separable port tethering means connected to said port support member for detachably connecting said port support member to a primary stay connected to said port spar;

separable starboard tethering means connected to said starboard support member for detachably connecting said starboard support member to a primary stay connected to said starboard spar;

a port nose rope connected to the bow portion of said port support member and to said secondary stay connected between said port spar end and said vertical spar end;

a starboard nose rope connected to the bow portion of said starboard support member and to said secondary stay connected between said starboard spar end and said vertical spar end; and a bow nose rope connected to the bow portion of said steering support member and to said vertical spar end.

13. A wind propelled watercraft comprising:

a buoyant steering support member;

a buoyant port support member;

a buoyant starboard support member, said support members spaced substantially equidistantly from each other;

a steering member spar pivotally connected to said steering support member at one end thereof and connected to a spar juncture at the other end thereof;

a port spar connected to said port support member at one end thereof and to said juncture at the other end thereof;

a starboard spar connected to said starboard support member at one end thereof and to said juncture at the other end thereof;

a vertical spar connected to said juncture extending vertically upwardly, said spars being substantially equilength and forming an angle of approximately 110° with each other at said juncture;

three substantially equilength primary stays connecting together the connecting ends of said steering, port and starboard spars and substantially forming an equilateral triangle;

three substantially equilength secondary stays, equal in length to said primary stays, connecting together the ends of said steering, port and starboard spars to the end of said vertical spar, whereby said primary and said secondary stays together form an equilateral tetrahedron;

at least one centerboard extending downwardly from each of said support members;

a port steering rein and a starboard steering rein, said reins connected to said steering support member;

first port pulley means connected to said primary stay connected between said steering spar end and said port spar end and first starboard pulley means connected to said primary stay connected between said steering spar end and said starboard spar end, said first port pulley means adapted for receiving therethrough said port rein and said first starboard pulley means adapted for receiving therethrough said starboard rein;

a trampoline connected to said steering, port and starboard spars;

second port pulley means connected to said trampoline for receiving therethrough said port rein; and second starboard pulley means connected to said trampoline for receiving therethrough said starboard rein, whereby tension can be provided to said respective reins to directionally adjust said steering support member.

14. The watercraft of claim 13 further comprising a rigid elongate trampoline support member fastened to said watercraft and two second pulley means securing ropes connected to said rigid elongate support member and connected to a respective second pulley means, whereby said second pulley means are aided to hold their position against forces created by said reins.

15. The watercraft of claim 14 wherein said second pulley means are grommets on said trampoline also used for tensioning said trampoline along said trampoline support member.

16. The watercraft of claim 3 wherein said steering support member centerboard is located directionally behind said pivotal connection between said steering spar end and said steering support member, and wherein said steering reins are connected to said steering support member behind said pivotal connection between said steering spar end and said steering support member.

17. The watercraft of claim 13 wherein said steering support member centerboard is located directionally forward of said pivotal connection between said steering spar end and said steering support member, and wherein said steering reins are connected to said steering support member behind said pivotal connection between said steering spar end and said steering support member.

18. The watercraft of claim 13 further comprising:

a trampoline storage pocket connected to said trampoline; and a zipper opening means connected to said storage pocket for selectively providing access within said pocket.

19. A wind propelled watercraft comprising:

a buoyant steering member;

a buoyant port support member;

a buoyant starboard support member, said support members spaced substantially equidistantly from each other;

a steering member spar pivotally connected to said steering support member at one end thereof and connected to a spar juncture at the other end thereof;

a port spar connected to said port support member at one end thereof and to said juncture at the other end thereof;

a starboard spar connected to said starboard support member at one end thereof and to said juncture at the other end thereof;

a vertical spar connected to said juncture extending vertically upwardly, said spars being substantially equilength and forming an angle of approximately 110° with each other at said juncture;

three substantially equilength primary stays connecting together the ends of said steering, port and starboard spars and substantially forming an equilateral triangle;

three substantially equilength secondary stays equal in length to said primary stays and connecting together the ends of said steering, port and starboard spars to the end of said vertical spar, whereby said primary and secondary stays together form an equilateral tetrahedron;

at least one centerboard extending downwardly from each of said support members;

a port steering rein and a starboard steering rein, said reins connected to said steering support member;

a first port pulley means connected to said primary stay connected between said steering spar end and said port spar end and a first starboard pulley means connected to said primary stay connected between said steering spar end and said starboard spar end, said first port pulley means adapted for receiving therethrough said port rein and said first starboard pulley means adapted for receiving therethrough said starboard rein;

a trampoline connected to said steering, port and starboard spars;

a rigid trampoline support member connected to said watercraft supporting said trampoline; and a second port side pulley means connected to said trampoline support member for receiving therethrough said port rein; and second starboard side pulley means connected to said trampoline support member for receiving therethrough said starboard rein, whereby tension can be provided on said respective reins so as to directionally adjust said steering support member.

20. The watercraft of claim 19 wherein said first port and starboard pulley means and said second port and starboard pulley means are made of nonabrasive polymer material

21. The watercraft of claim 19 further comprising cleat means connected to said vertical spar for fastening thereto said port and starboard reins.

22. The watercraft of claim 19 wherein said steering support member centerboard is located behind said pivotal connection and wherein said reins are connected to said steering support member behind said pivotal connection.

23. The watercraft of claim 19 further comprising:

a turnbuckle on a secondary stay whereby said stays can effectively be tensioned.

24. The watercraft of claim 23 further comprising:

a semicircular eye connected to said steering member spar end;

a semicircular eye connected to said vertical spar end;

a sail connected to each of said semicircular eyes connected to said respective steering member spar end and vertical spar end; and a sail rear portion securing means for securing said sail back portion to said watercraft.

25. The watercraft of claim 24 wherein said rear portion securing means comprises a rope connected to said sail rear portion positionable around said primary stay connecting said port spar end and said starboard spar end and thereafter fastenable to said port spar member and said starboard spar member.

26. The watercraft of claim 24 wherein said rear portion securing means comprises a rope connected to said sail rear portion positionable around said primary stay connecting said port spar end and said starboard spar end and thereafter fastenable to a plurality of cleats connected to said port spar member and said starboard spar member.

27. The watercraft of claim 19 further comprising:

at least one trampoline support stay connected to substantially the end of said vertical spar and to said trampoline; and pulling means connected to said trampoline support stay and a respective secondary stay for pulling said trampoline support stay in an outboard direction towards said secondary stay.

28. The watercraft of claim 27 wherein said pulling means comprises:

a first annular member receiving therethrough said trampoline support stay and said respective secondary stay; and attaching means connected to said annular member for attaching said first annular member to said respective secondary stay.

29. The watercraft of claim 7 wherein said attaching means comprises:

a second annular member connected to said respective secondary stay; and an S-hook for detachably connecting together said first annular member and said second annular member.

* * * * *